US010544790B2

(12) United States Patent
Horng et al.

(10) Patent No.: US 10,544,790 B2
(45) Date of Patent: Jan. 28, 2020

(54) CEILING FAN INCLUDING A HEAT-DISSIPATING DEVICE

(71) Applicant: Sunonwealth Electric Machine Industry Co., Ltd., Kaohsiung (TW)

(72) Inventors: Alex Horng, Kaohsiung (TW); Tso-Kuo Yin, Kaohsiung (TW); Cheng-Wei Lin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 15/871,303

(22) Filed: Jan. 15, 2018

(65) Prior Publication Data

US 2019/0072097 A1 Mar. 7, 2019

(30) Foreign Application Priority Data

Sep. 4, 2017 (TW) ..... 106130186 A

(51) Int. Cl.
*F04D 25/08* (2006.01)
*F04D 29/34* (2006.01)
*F04D 29/38* (2006.01)

(52) U.S. Cl.
CPC ..... *F04D 25/088* (2013.01); *F04D 29/34* (2013.01); *F04D 29/388* (2013.01)

(58) Field of Classification Search
CPC ..... F04D 25/088; F04D 25/082; F04D 29/34; F04D 29/388; F04D 29/681; F04D 29/584; F04D 29/58
USPC ..... 416/146 R
See application file for complete search history.

(56) References Cited

U.S. PATENT DOCUMENTS

2008/0031726 A1* 2/2008 Bernardus Olthof ... F04D 29/34 415/115
2015/0308438 A1* 10/2015 Janecek ..... F04D 25/082 417/53
2016/0290357 A1* 10/2016 Whitley ..... F04D 29/388

* cited by examiner

*Primary Examiner* — Igor Kershteyn
(74) *Attorney, Agent, or Firm* — Alan D. Kamrath; Karin L. Williams; Mayer & Williams PC

(57) ABSTRACT

A ceiling fan includes a motor and a heat-dissipating device. The heat-dissipating device includes a plurality of blades and a plurality of end plates. The motor includes a shaft and a hub. The hub includes a plurality of vents and a plurality of first coupling portions. Each blade is coupled with at least one first coupling portion and includes a first end and a second end. Each blade forms a second coupling portion at the first end thereof. The second coupling portion is coupled with the at least one first coupling portion. Each blade includes a first air channel extending in a radial direction. The first air channel includes first and second ends. The first end of the first air channel is relatively adjacent to the vents than the second end is. Each end plate includes at least one third coupling portion coupled with the second end of the blade.

19 Claims, 9 Drawing Sheets

CEILING FAN INCLUDING A HEAT-DISSIPATING DEVICE

CROSS REFERENCE TO RELATED APPLICATIONS

The application claims the benefit of Taiwan application serial No. 106130186, filed on Sep. 4, 2017, and the entire contents of which are incorporated herein by reference.

BACKGROUND OF THE INVENTION

1. Field of the Invention

The present invention generally relates to a ceiling fan including a heat-dissipating device and, more particularly, to a ceiling fan including a heat-dissipating device which permits the heat generated by the heat source of the ceiling fan to be dissipated through the blades of the heat-dissipating device during the rotation of the blades.

2. Description of the Related Art

During the rotation of a conventional ceiling fan, the motor of the ceiling fan continues to generate heat due to constant operation thereof. To dissipate the heat, a plurality of vents is formed in the housing of the ceiling fan. However, since the housing is located on a rotation center of the ceiling fan, the dissipated heat will remain on the housing. Thus, the heat cannot be dissipated properly. Furthermore, since the temperature of the ceiling fan is proportional to the operational time, the ceiling fan will have a higher temperature after a long time of operation.

In light of this, it is necessary to improve the ceiling fan.

SUMMARY OF THE INVENTION

It is therefore the objective of this invention to provide a ceiling fan including a heat-dissipating device.

In an embodiment of the invention, a ceiling fan includes a heat-dissipating device. The ceiling fan includes a motor, a plurality of blades, and a plurality of end plates. The motor includes a shaft and a hub rotating with the shaft. The hub includes a plurality of vents and a plurality of first coupling portions. Each of the plurality of blades is provided with at least one of the plurality of first coupling portions and includes a first end and a second end spaced from the first end in a radial direction. Each of the plurality of blades forms a second coupling portion at the first end thereof. The second coupling portion is coupled with the at least one of the plurality of first coupling portions. Each of the plurality of blades includes a first air channel extending in the radial direction. The first air channel includes a first end and a second end. The first end of the first air channel is relatively adjacent to the plurality of vents than the second end is. Each of the plurality of end plates includes at least one third coupling portion coupled with the second end of a corresponding one of the plurality of blades.

Based on above, with the ceiling fan including the heat-dissipating device according to the invention, the blade includes at least one first air channel whose first end is adjacent to the first and second vents, the at least one third coupling portion is coupled with the blade, and the at least one second air channel of the end plate is in communication with the at least one first air channel. In this arrangement, during the operation of the motor, the heat currents dissipated through the first and second vents can be guided to the at least one second air channel via the at least one first air channel. As a result, the heat currents that are generated during the operation of the motor and that are expelled from the first and second vents is guided from the first end to the second end of the first air channel. Therefore, the heat currents can be expelled from the blade in the radial direction. In this arrangement, the blade can have a better appearance while an excellent heat-dissipating effect and an excellent flow-guiding effect are attained.

In an example, each of the plurality of blades includes at least one channel extending from the first end through the second end of the blade in the radial direction. Thus, the weight of the blades of the blade is reduced.

In an example, each of the plurality of first coupling portions is in a form of a rod, the second coupling portion is formed by the at least one channel, and the rod is inserted into the at least one channel. Thus, convenient processing and manufacturing is attained.

In an example, each rod includes at least one first fixing hole, each of the plurality of blades includes at least one second fixing hole, and at least one fastener extends through the at least one first fixing hole and the at least one second fixing hole to fix one of the plurality of blades to a corresponding one of the rods. Thus, a better fixing effect is attained.

In an example, a quantity of the at least one of the plurality of first coupling portions for each of the plurality of blades is smaller than a quantity of the at least one channel of each of the plurality of blades. This can ensure that the heat currents dissipated from the first and second vents can be discharged from the blade through the first air channel.

In an example, the at least one third coupling portion of each of the plurality of end plates is coupled with the at least one channel of a corresponding one of the plurality of blades. Thus, the blade can have a better appearance at the second end thereof.

In an example, each of the at least one third coupling portion is in a form of a projection, each of the plurality of blades includes at least one second fixing hole, and the projection includes at least one third fixing hole. In this regard, at least one fastener extends through the at least one second fixing hole and the at least one third fixing hole to fix one of the plurality of end plates to the corresponding one of the plurality of blades.

In an example, each of the plurality of end plates includes at least one second air channel, and each of the at least one second air channel includes an inlet end communicating with the first air channel. This can ensure that the heat currents dissipated from the first and second vents can be discharged from the blade through the first and second air channels.

In an example, each of the at least one second air channel includes an open end opposite to the inlet end. This can ensure that the heat currents can be discharged from the blade through the open end.

In an example, the at least one second air channel is formed on a bottom face of a corresponding one of the plurality of end plates. This can ensure that the heat currents dissipated from the first and second vents can be discharged from the blade through the first and second air channels while preventing dust from accumulating in the second air channel.

In an example, the at least one second air channel is formed on a top face of a corresponding one of the plurality of end plates. This can ensure that the heat currents dissipated from the first and second vents can be discharged from the blade through the first and second air channels.

In an example, the at least one second air channel is formed on a top face and a bottom face of the end plate, and each of the top and bottom faces includes the open end. This can ensure that the heat currents dissipated from the first and second vents can be discharged from the blade through the first and second air channels.

In an example, the at least one second air channel extends through the each of the plurality of end plates in the radial direction. This can ensure that the heat currents dissipated from the first and second vents can be discharged from the blade through the first and second air channels.

In an example, the at least one second air channel is formed radially inside the end plate and extends in a curved manner to form an open end on a bottom face of the end plate. This can ensure that the heat currents dissipated from the first and second vents can be discharged from the blade through the first and second air channels.

In an example, each of the plurality of blades is located between two adjacent ones of the plurality of vents. This can ensure that the heat currents dissipated from the first and second vents can be discharged from the blade through the first air channel.

In an example, each of the plurality of blades is radially aligned with a corresponding one of the plurality of vents. This can ensure that the heat currents dissipated from the first and second vents can be discharged from the blade through the first air channel.

In an example, each of the plurality of end plates has a same outline as a corresponding one of the plurality of blades. Thus, a better appearance is provided.

In an example, each of the plurality of blades includes an extension portion at the first end thereof, and the extension portion extends radially towards the shaft and covers a corresponding one of the plurality of vents. Thus, the heat currents dissipated from the first and second vents can be guided into the first air channel of the blade.

In an example, the at least one third coupling portion does not completely block off the first air channel when coupled with the first air channel. This can ensure that the heat currents dissipated from the first and second vents can be discharged from the blade through the first air channel and the gap(s) between the at least one third coupling portion.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
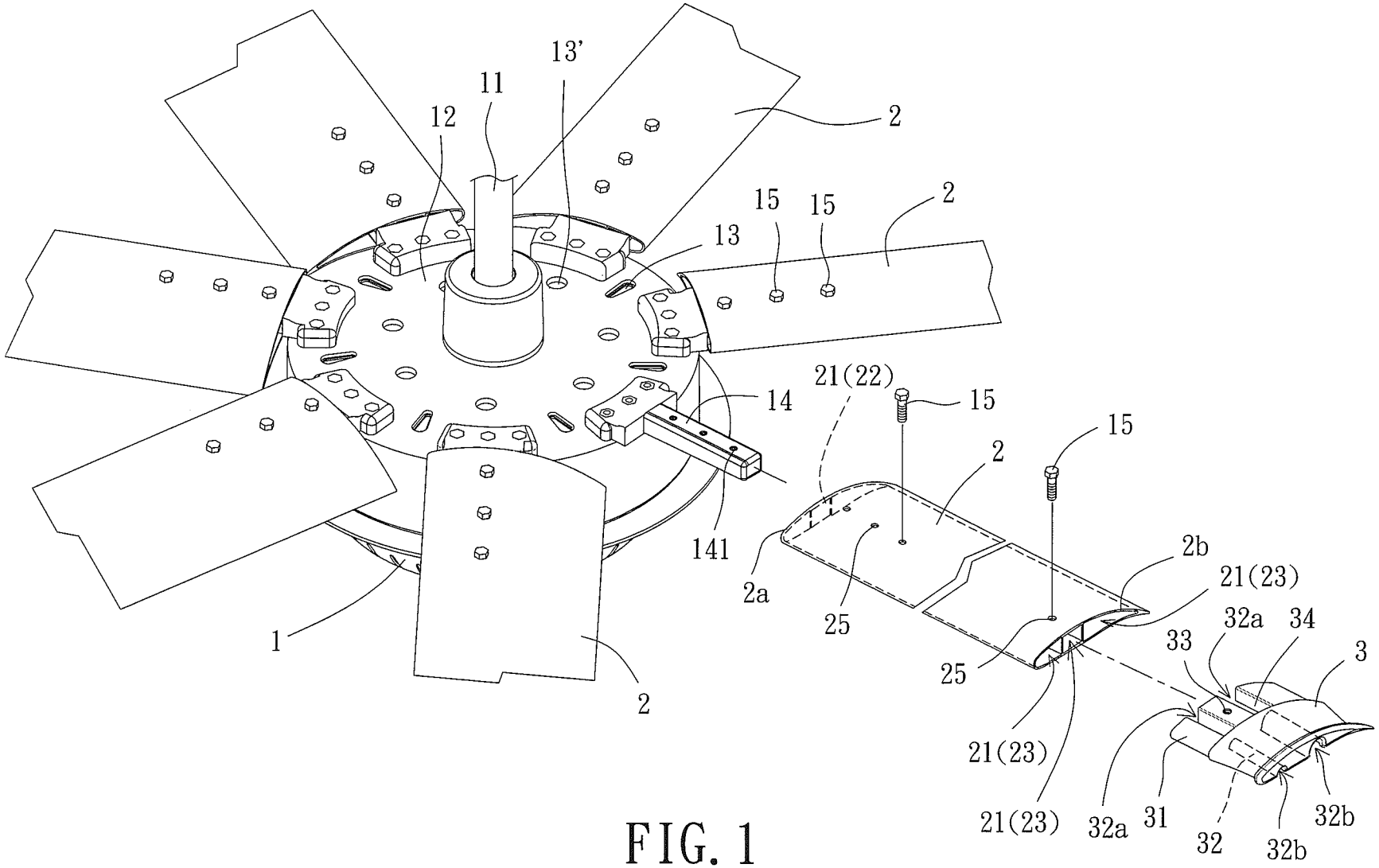
FIG. 1 is a partially exploded, perspective view of a ceiling fan including a heat-dissipating device according to a first embodiment of the invention.

In the various figures of the drawings, the same numerals designate the same or similar parts. Furthermore, when the terms "first", "second", "third", "top", "bottom", "downward", "upward", "radial", "length", "end" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
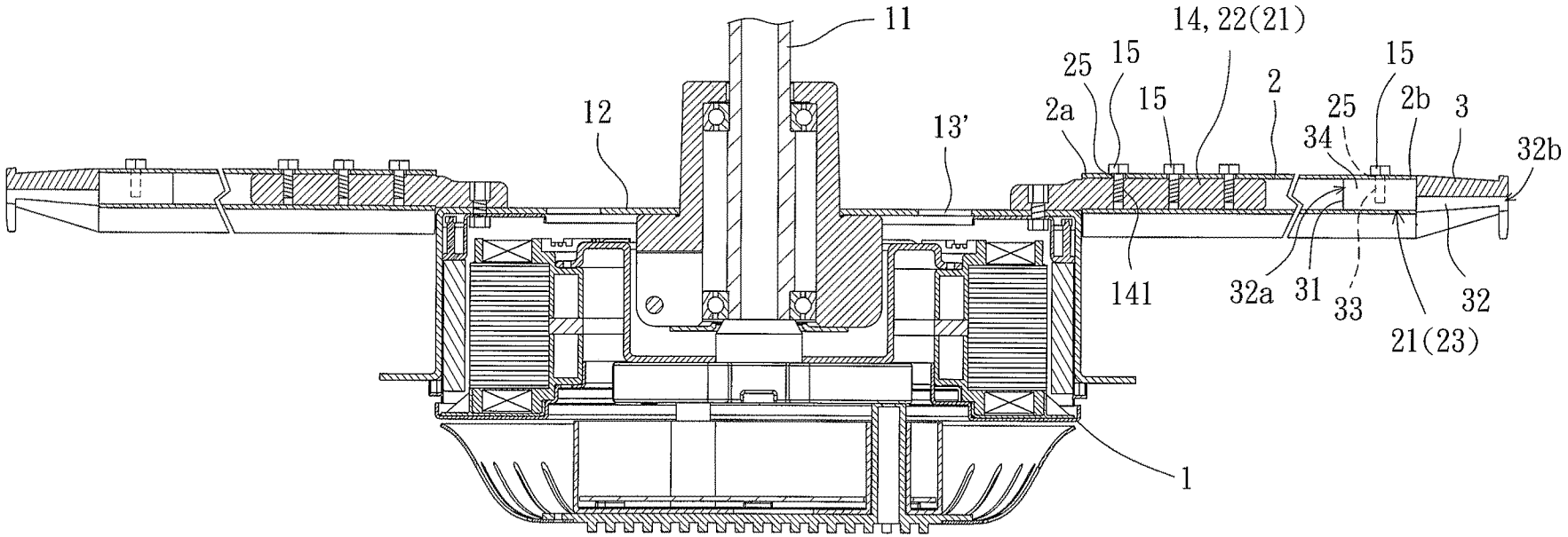
FIG. 2 is a cross-sectional, assembled view of the ceiling fan including the heat-dissipating device according to the first embodiment of the invention.

FIGS. 1 and 2 show a ceiling fan including a motor 1. The ceiling fan further includes a heat-dissipating device according to a first embodiment of the invention. The heat-dissipating device includes a plurality of blades 2 and a plurality of end plates 3. The motor 1 is coupled with a shaft 11. Each of the blades 2 includes a first end connected to a hub 12 of the motor 1. Thus, the blades 2 can rotate relatively to the shaft 11. Each of the end plates 3 is connected to a respective blade 2.

Referring to FIGS. 1 and 2, the shaft 11 includes an end fixed to an object. The motor 1 can drive the hub 12 to rotate. The hub 12 includes a plurality of first vents 13, a plurality of second vents 13' and a plurality of first coupling portions 14. Each of the blades 2 is coupled with at least one of the first coupling portions 14. The heat currents generated during operation of the motor 1 can be dissipated through the first vents 13 and the second vents 13'. The first coupling portions 14 can be coupled with the blades 2. In this embodiment, each of the first coupling portions 14 is in the form of a rod as shown.

Referring to FIGS. 1 and 2, each of the blades 2 has a length extending in a radial direction and includes a first end 2*a* and a second end 2*b*. The blades 2 are formed by extrusion of a metal material such as aluminum. To reduce the weight, each blade 2 may include at least one channel 21. The at least one channel 21 extends through each blade 2 from the first end 2*a* to the second end 2*b*. In this embodiment, each blade 2 includes three channels 21. A second coupling portion 22 is provided at the first end 2*a* of each blade 2. The second coupling portion 22 is coupled with a corresponding one of the first coupling portions 14 of the hub 12. Thus, each of the blades 2 can be located between two first vents 13 or is radially aligned with a respective second vent 13'.

Referring to FIGS. 1 and 2, in this embodiment, the second coupling portion 22 is formed by the at least one channel 21. Thus, the corresponding first coupling portion 14 in the form of the rod can be inserted into the at least one channel 21. Each first coupling portion 14 includes a plurality of first fixing holes 141, and each blade 2 includes a plurality of second fixing holes 25. Each of the first fixing holes 141 corresponds to a respective second fixing hole 25. A fastener 15 extends through the corresponding first and second fixing holes 141 and 25 to fix the first end 2*a* of each blade 2 to the hub 12. When each of the first coupling portions 14 is in the form of a rod, the quantity of the first coupling portions 14 for each blade 2 is smaller than the quantity of the channels 21 of each blade 2. Thus, the remaining channel(s) 21 which is not provided with the second coupling portion 22 can form a first air channel 23 (or plural first air channels 23). The first end 2*a* of each blade 2 which forms the first air channel(s) 23 is adjacent to the first and second vents 13 and 13'. The heat currents that are discharged from the first and second vents 13 and 13' can flow into the first air channel(s) 23 and are expelled from the second end 2*b* of each blade 2.

Figure 3:
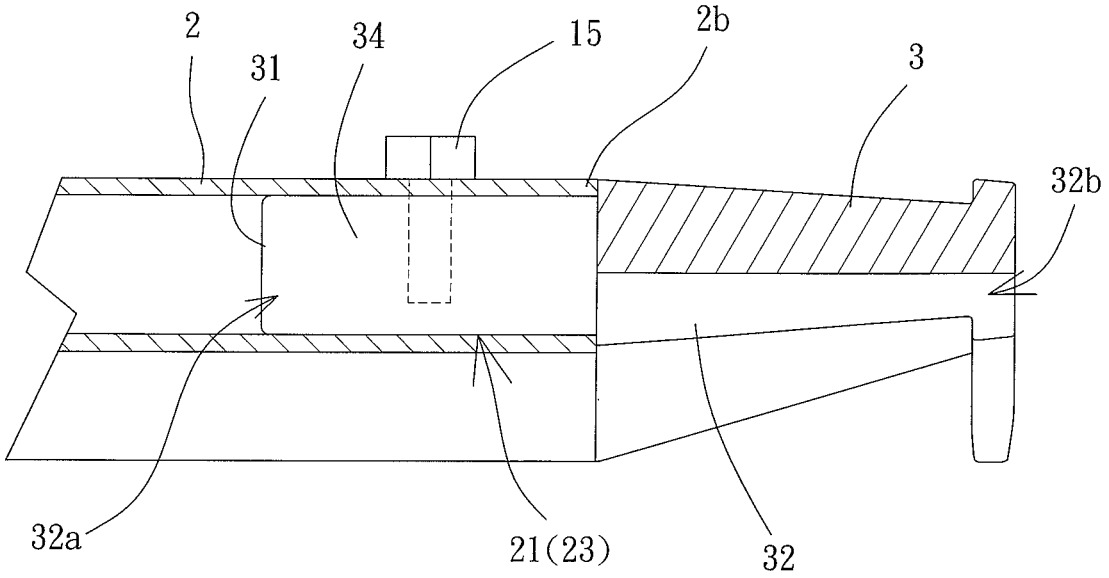
FIG. 3 is a partial, cross-sectional view of the heat-dissipating device of the first embodiment of the invention showing a combination of the blade and the end plate of the heat-dissipating device.

Referring to FIGS. 1 and 3, each of the end plates 3 is coupled with the second end 2*b* of each blade 2. The outline of the end plate 3 is preferably the same as that of each blade 2. For example, the end plate 3 includes an end distant to the shaft 11 and forming a wing shape, and each blade 2 also includes an end (second end 2*b*) distant to the shaft 11 and forming the wing shape. Thus, each blade 2 can have a better appearance (streamlined outline) at the second end 2*b*. The end plate 3 includes at least one third coupling portion 31. Each third coupling portion 31 is in the form of a projection as shown in FIG. 1. This permits each third coupling portion 31 to be inserted into a respective channel 21 which is not used as a first air channel 23. The end plate 3 includes at least one third fixing hole 33 corresponding to the second fixing hole(s) 25. The fastener 15 extends through the second and third fixing holes 25 and 33 to fix the second end 2*b* of each blade 2 to the end plate 3.

Referring to FIGS. 1 and 3, each of the end plates 3 includes at least one second air channel 32. When each third coupling portion 31 is inserted into the first air channel 23, an inlet end 32*a* of each second air channel 32 is in communication with the first air channel 23. Furthermore, the second air channel 32 includes an open end 32*b*, and the heat currents can be discharged from the second air channel 32 and the open end 32*b*. Since the at least one third coupling portion 31 is coupled with each blade 2, the second end 2*b* of each blade 2 can have a better appearance while an improved flow-guiding effect is provided.

Referring to FIGS. 2 and 3, based on the above structure, the shaft 11 can be fixed to a predetermined location of an object such as a ceiling. Since the hub 12 includes the first and second vents 13 and 13', since each blade 2 includes the first air channel(s) 23, and since the at least one third coupling portion 31 of each end plate 3 is coupled with each blade 2, the heat currents generated during the operation of the motor 1 and dissipated through the first and second vents 13 and 13' can be guided to the at least one second air channel 32 of each of the end plates 3 via the first air channel(s) 23. Thus, the heat currents can be expelled from the heat-dissipating device in the radial direction. In this arrangement, the second end 2*b* of the respective blade 2 can have a better appearance while an excellent heat-dissipating effect and an excellent flow-guiding effect are provided.

Figure 4:
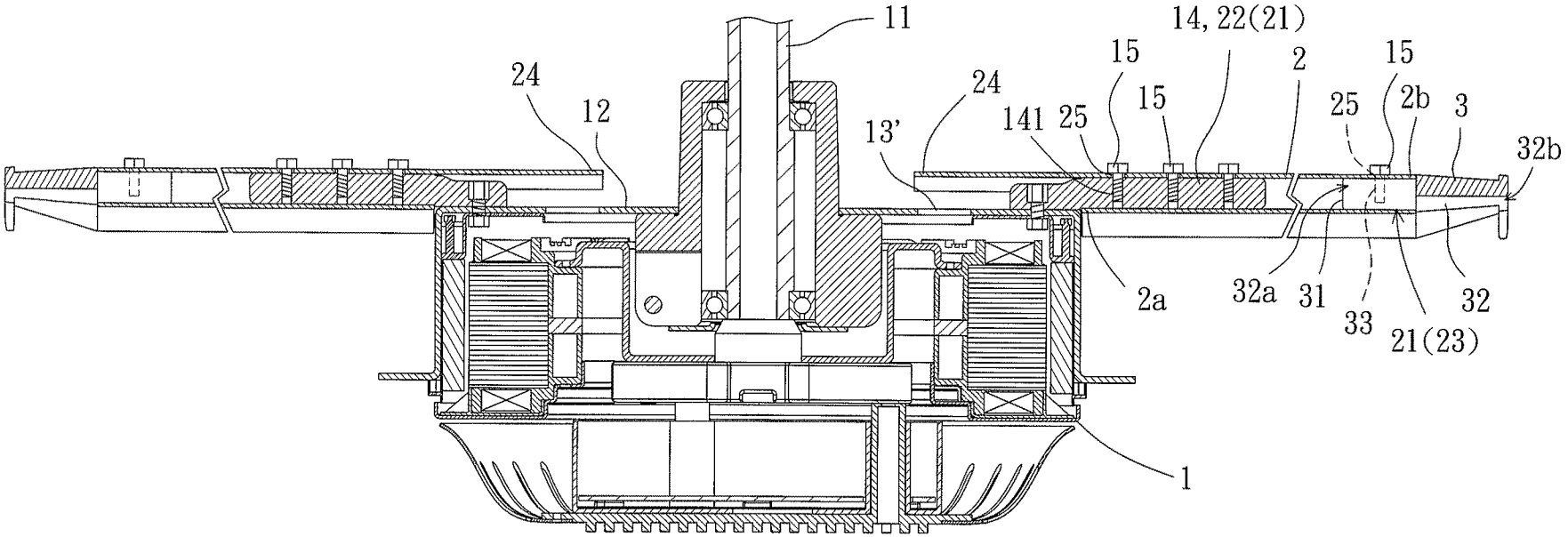
FIG. 4 is a cross-sectional, assembled view of a ceiling fan including a heat-dissipating device according to a second embodiment of the invention.

FIG. 4 shows a ceiling fan including a heat-dissipating device according to a second embodiment of the invention. The second embodiment is substantially the same as but differs from the first embodiment in that each blade 2 further includes an extension portion 24 at the first end 2*a* thereof. The extension portion 24 extends radially towards the shaft 11 and covers the second vent 13'. Thus, the heat currents dissipated from the second vent 13' can flow into the first air channel 23. The heat in the first air channel(s) 23 can be further guided to the second air channel 32 of the end plate 3 to be radially discharged from the second air channel 32. In this arrangement, the second end 2*b* of each blade 2 can have a better appearance while an excellent heat-dissipating effect and an excellent flow-guiding effect are provided.

Figure 5:
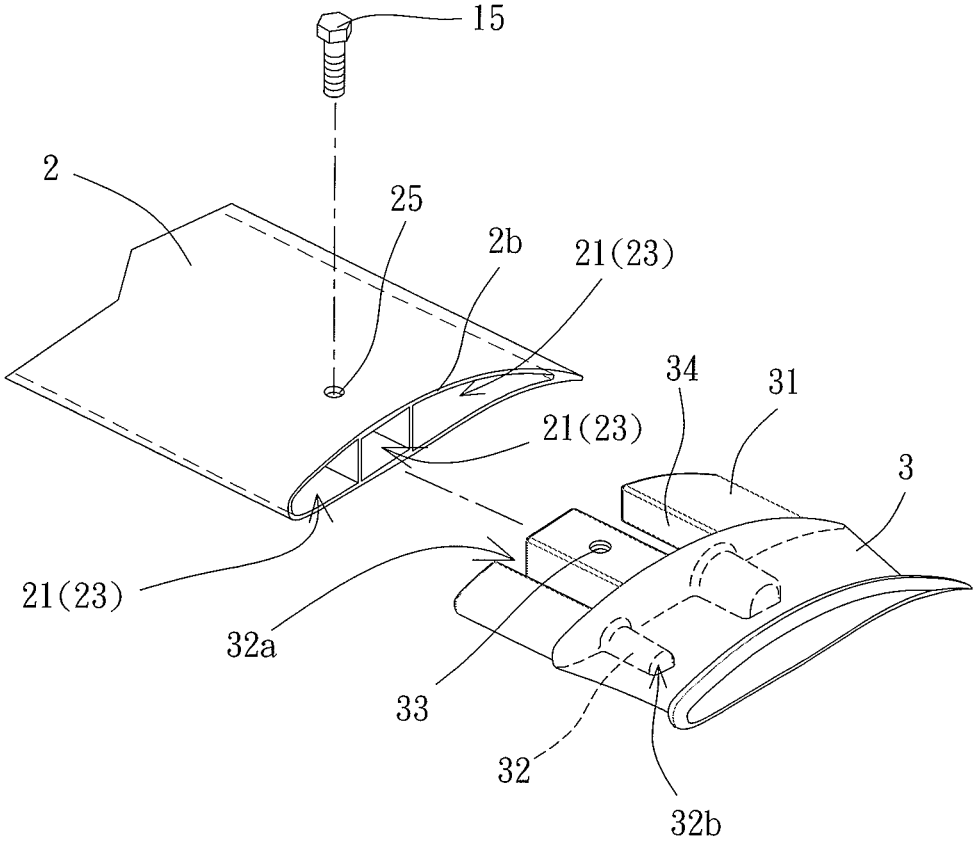
FIG. 5 is a partial, exploded, perspective view of a blade and an end plate of a heat-dissipating device of a ceiling fan according to a third embodiment of the invention.
Figure 6:
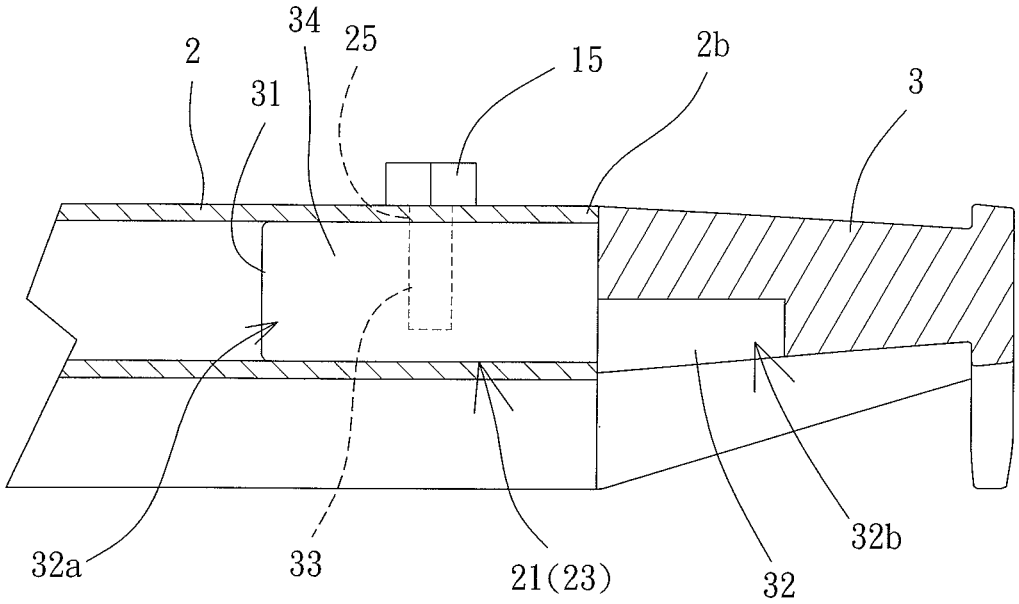
FIG. 6 is a cross-sectional, assembled view of the blade and the end plate in FIG. 5.

FIGS. 5 and 6 show a heat-dissipating device of a ceiling fan according to a third embodiment of the invention. The third embodiment is substantially the same as but differs from the first embodiment in that the open end 32*b* of the at least one second air channel 32 is formed in the bottom face of each end plate 3. This can prevent dust from accumulating in the at least one second air channel 32. In addition, the heat currents dissipated from the first and second vents 13 and 13' can be guided to the at least one second air channel 32 of each end plate 3 via the first air channel(s) 23 to be discharged in a downward direction. In this arrangement, the second end 2*b* of each blade 2 can have a better appearance while an excellent heat-dissipating effect and an excellent flow-guiding effect are provided.

Figure 7:
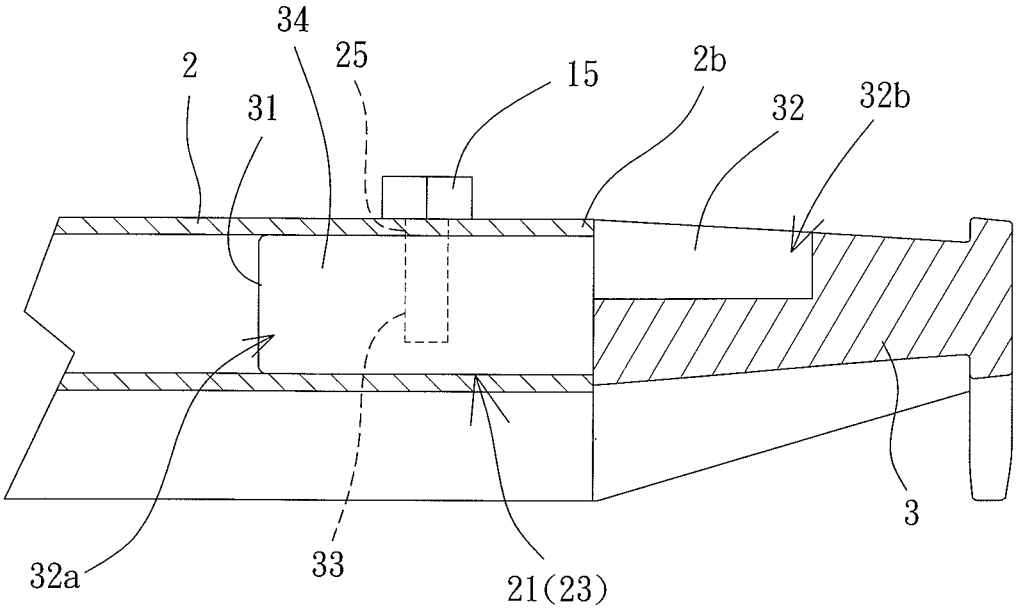
FIG. 7 is a cross-sectional, assembled view of a blade and an end plate of a heat-dissipating device of a ceiling fan according to a fourth embodiment of the invention.

FIG. 7 shows a heat-dissipating device of a ceiling fan according to a fourth embodiment of the invention. The fourth embodiment is substantially the same as but differs from the first embodiment in that the open end 32*b* of the at least one second air channel 32 is formed on the top face of each end plate 3. Thus, the heat currents dissipated from the first and second vents 13 and 13' can be guided to the second air channel 32 of each end plate 3 via the first air channel(s) 23 to be discharged in an upward direction. In this arrangement, an excellent heat-dissipating effect and an excellent flow-guiding effect can be provided.

Figure 8:
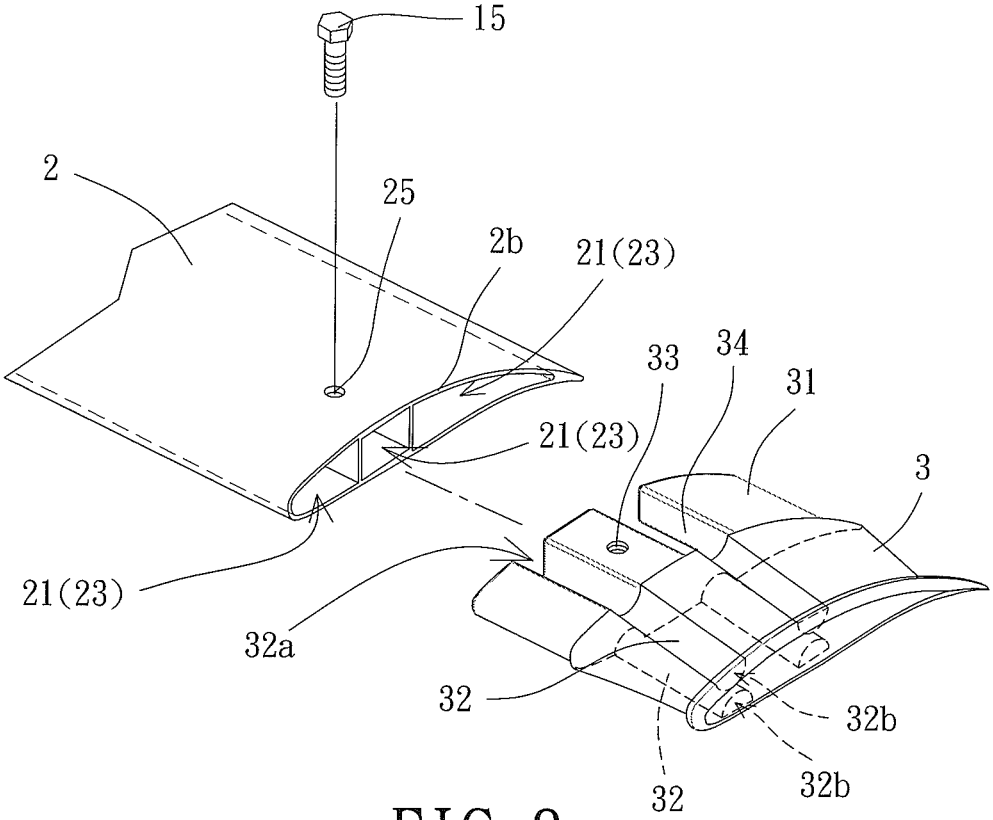
FIG. 8 is a partial, exploded, perspective view of a blade and an end plate of a heat-dissipating device of a ceiling fan according to a fifth embodiment of the invention.
Figure 9:
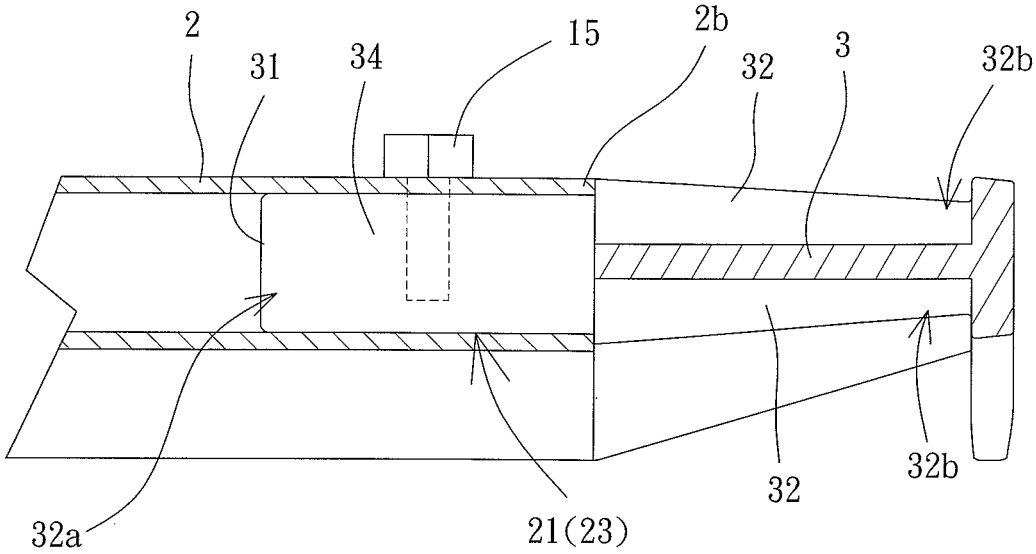
FIG. 9 is a cross-sectional, assembled view of the blade and the end plate in FIG. 8.

FIGS. 8 and 9 show a heat-dissipating device of a ceiling fan according to a fifth embodiment of the invention. The fifth embodiment is substantially the same as but differs from the first embodiment in that each of the top and bottom faces of each end plate 3 includes the at least one second air channel 32. Each of the two second air channels 32 includes the open end 32*b*. The heat currents dissipated from the first and second vents 13 and 13' can be guided to the second air channel 32 of each end plate 3 via the first air channel 23 in order to be discharged in both the upward and downward directions. In this arrangement, the second end 2*b* of each blade 2 can have a better appearance while the excellent heat-dissipating and flow-guiding effects are provided.

Figure 10:
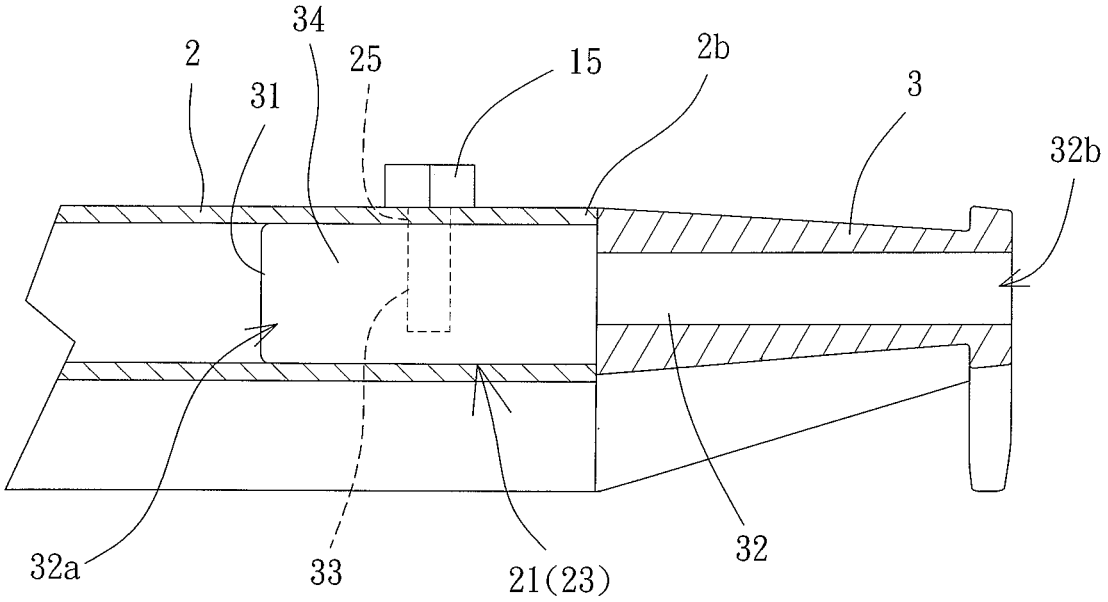
FIG. 10 is a cross-sectional, assembled view of a blade and an end plate of a heat-dissipating device of a ceiling fan according to a sixth embodiment of the invention.

FIG. 10 shows a heat-dissipating device of a ceiling fan according to a sixth embodiment of the invention. The sixth embodiment is substantially the same as but differs from the first embodiment in that the at least one second air channel 32 radially extends through the end plate 3. In this arrangement, the heat currents dissipated from the first and second vents 13 and 13' can be guided to the second air channel 32 via the first air channel 23 and then are discharged from the open end 32*b*. Therefore, the heat currents are discharged in the radial direction. In this arrangement, the second end 2*b* of each blade 2 can have a better appearance while an excellent heat-dissipating effect and an excellent flow-guiding effect are provided.

Figure 11:
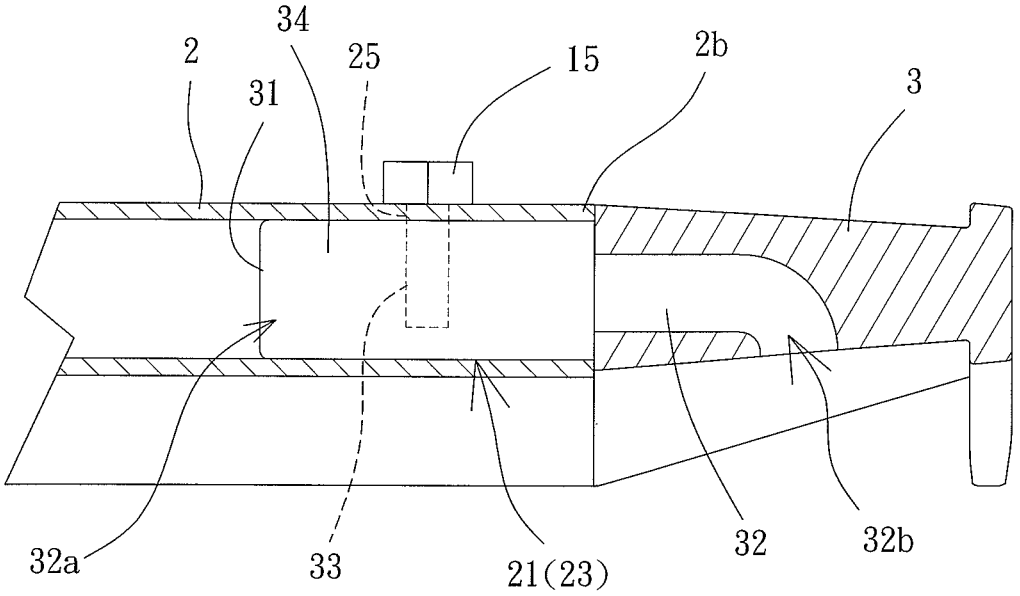
FIG. 11 is a cross-sectional, assembled view of a blade and an end plate of a heat-dissipating device of a ceiling fan according to a seventh embodiment of the invention.

FIG. 11 shows a heat-dissipating device of a ceiling fan according to a seventh embodiment of the invention. The seventh embodiment is substantially the same as but differs from the first embodiment in that the at least one second air channel 32 is inside the end plate 3 and extends in a curved manner to form the open end 32*b* in the bottom face of the end plate 3. The heat currents dissipated from the first and second vents 13 and 13' can be guided to the second air channel 32 via the first air channel 23 in order to be discharged from the open end 32*b*. Therefore, the heat currents are discharged in a downward direction. In this arrangement, the second end 2*b* of each blade 2 can have a better appearance while an excellent heat-dissipating effect and an excellent flow-guiding effect are provided.

Figure 12:
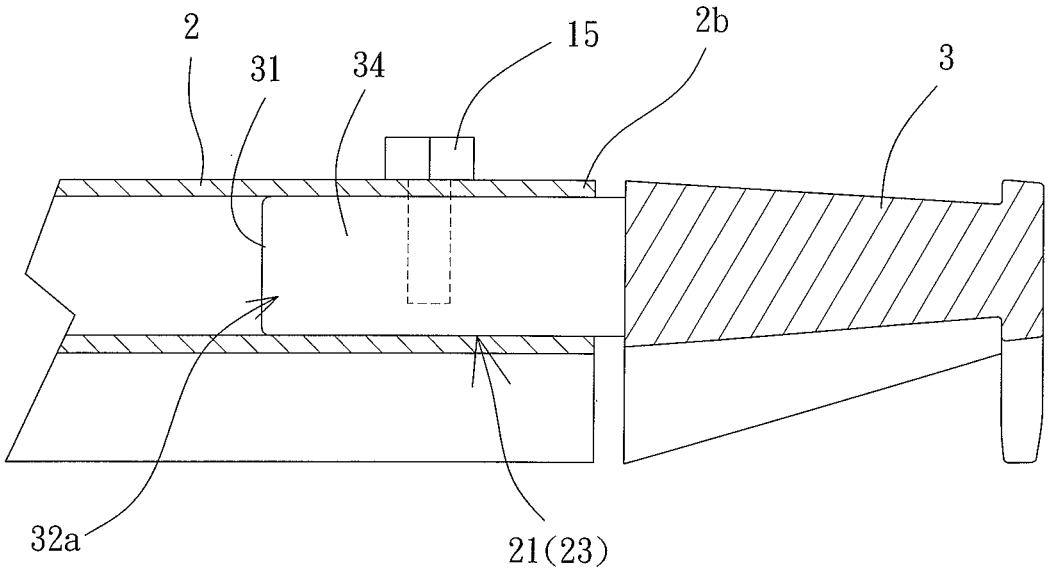
FIG. 12 is a cross-sectional, assembled view of a blade and an end plate of a heat-dissipating device of a ceiling fan according to an eighth embodiment of the invention.

FIG. 12 shows a heat-dissipating device of a ceiling fan according to an eighth embodiment of the invention. The eighth embodiment is substantially the same as but differs from the first embodiment in that each end plate 3 does not include any second air channel 32 and that the third coupling portion 31 is inserted into but does completely block off the first air channel(s) 23. In this regard, each of the third coupling portions 31 is partially located outside of the first air channel(s) 23. There is at least one gap 34 formed between the third coupling portions 31 and communicating with the first air channel(s) 23. The heat currents that are discharged from the first and second vents 13 and 13' can be guided to the at least one gap 34 via the first air channel(s) 23, and then are discharged from the at least one gap 34. Thus, an excellent heat-dissipating effect and an excellent flow-guiding effect can be provided.

In summary, with the heat-dissipating devices of the ceiling fans according to the invention, each blade includes at least one first air channel whose first end is adjacent to the first and second vents, the at least one third coupling portion of the end plate is coupled with the blade, and an at least one second air channel of an end plate is in communication with at least one first air channel. In this arrangement, during the operation of the motor, the heat currents dissipated through the first and second vents can be guided through the at least one first air channel in the radial direction and transferred to the at least one second air channel. As a result, the heat currents can finally be expelled from the open end of the blade in an upward, downward or radial direction. Thus, the second end of each blade can have a better appearance while an excellent heat-dissipating effect and an excellent flow-guiding effect are provided.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A ceiling fan including a heat-dissipating device, comprising:

a motor including a shaft and a hub, wherein the motor is operable to drive the hub to rotate, wherein the hub includes a plurality of vents and a plurality of first coupling portions; and a plurality of blades, wherein each of the plurality of blades is coupled with at least one of the plurality of first coupling portions and includes a first end and a second end spaced from the first end in a radial direction, wherein each of the plurality of blades forms a second coupling portion at the first end thereof, wherein the second coupling portion is coupled with the at least one of the plurality of first coupling portions, wherein each of the plurality of blades includes a first air channel extending in the radial direction, wherein the first air channel includes a first end and a second end, and wherein the first end of the first air channel is relatively adjacent to the plurality of vents compared to the second end; and a plurality of end plates, wherein each of the plurality of end plates includes at least one third coupling portion coupled with the second end of a corresponding one of the plurality of blades, wherein each of the plurality of end plates has first and second axial sides spaced from each other in an axial direction perpendicular to the radial direction, and wherein each of the plurality of end plates includes at least one second air channel located at the first or second axial side.

2. The ceiling fan including the heat-dissipating device as claimed in claim 1, wherein each of the plurality of blades includes at least one channel extending from the first end through the second end of the blade in the radial direction.

3. The ceiling fan including the heat-dissipating device as claimed in claim 2, wherein each of the plurality of first coupling portions is in a form of a rod, wherein the second coupling portion is formed by the at least one channel, and wherein each rod is inserted into the at least one channel.

4. The ceiling fan including the heat-dissipating device as claimed in claim 3, wherein each rod includes at least one first fixing hole, wherein each of the plurality of blades includes at least one second fixing hole, and wherein at least one fastener extends through the at least one first fixing hole and the at least one second fixing hole to fix one of the plurality of blades to a corresponding one of the rods.

5. The ceiling fan including the heat-dissipating device as claimed in claim 3, wherein a quantity of the at least one of the plurality of first coupling portions for each of the plurality of blades is smaller than a quantity of the at least one channel of the each of the plurality of blades.

6. The ceiling fan including the heat-dissipating device as claimed in claim 2, wherein the at least one third coupling portion of each of the plurality of end plates is coupled with the at least one channel of a corresponding one of the plurality of blades.

7. The ceiling fan including the heat-dissipating device as claimed in claim 6, wherein each of the at least one third coupling portion is in a form of a projection, wherein each of the plurality of blades includes at least one second fixing hole, wherein the projection includes at least one third fixing hole, and wherein at least one fastener extends through the at least one second fixing hole and the at least one third fixing hole to fix one of the plurality of end plates to the corresponding one of the plurality of blades.

8. The ceiling fan including the heat-dissipating device as claimed in claim 1, wherein each of the at least one second air channel includes an inlet end communicating with the first air channel.

9. The ceiling fan including the heat-dissipating device as claimed in claim 8, wherein each of the at least one second air channel includes an open end opposite to the inlet end.

10. A ceiling fan including a heat-dissipating device, comprising:

a motor including a shaft and a hub, wherein the motor is operable to drive the hub to rotate, wherein the hub includes a plurality of vents and a plurality of first coupling portions; and a plurality of blades, wherein each of the plurality of blades is coupled with at least one of the plurality of first coupling portions and includes a first end and a second end spaced from the first end in a radial direction, wherein each of the plurality of blades forms a second coupling portion at the first end thereof, wherein the second coupling portion is coupled with the at least one of the plurality of first coupling portions, wherein each of the plurality of blades includes a first air channel extending in the radial direction, wherein the first air channel includes a first end and a second end, and wherein the first end of the first air channel is relatively adjacent to the plurality of vents than the second end is; and a plurality of end plates, wherein each of the plurality of end plates includes at least one third coupling portion coupled with the second end of a corresponding one of the plurality of blades, wherein each of the plurality of end plates further includes at least one second air channel, and wherein the at least one second air channel is formed on a bottom face of a corresponding one of the plurality of end plates.

11. The ceiling fan including the heat-dissipating device as claimed in claim 1, wherein the at least one second air channel is formed on a top face of a corresponding one of the plurality of end plates at one of the first and second axial sides.

12. The ceiling fan including the heat-dissipating device as claimed in claim 1, wherein the at least one second air channel is formed on a top face and a bottom face of a corresponding one of the plurality of end plates at one of the first and second axial sides.

13. The ceiling fan including the heat-dissipating device as claimed in claim 8, wherein the at least one second air channel extends through the each of the plurality of end plates in the radial direction.

14. The ceiling fan including the heat-dissipating device as claimed in claim 8, wherein the at least one second air channel is formed radially inside the each of the plurality of end plates and extends in a curved manner to form an open end on a bottom face of the each of the plurality of end plates.

15. The ceiling fan including the heat-dissipating device as claimed in claim 8, wherein each of the plurality of blades is located between two adjacent ones of the plurality of vents.

16. The ceiling fan including the heat-dissipating device as claimed in claim 8, wherein each of the plurality of blades is radially aligned with a corresponding one of the plurality of vents.

17. The ceiling fan including the heat-dissipating device as claimed in claim 8, wherein each of the plurality of end plates has a same outline as a corresponding one of the plurality of blades.

18. The ceiling fan including the heat-dissipating device as claimed in claim 1, wherein each of the plurality of blades includes an extension portion at the first end thereof, and wherein the extension portion extends radially towards the shaft and covers a corresponding one of the plurality of vents.

19. The ceiling fan including the heat-dissipating device as claimed in claim 1, wherein the at least one third coupling portion does not completely block off the first air channel when coupled with the first air channel.

* * * * *